US010397680B2

(12) United States Patent
Alwicker et al.

(10) Patent No.: US 10,397,680 B2
(45) Date of Patent: Aug. 27, 2019

(54) HEADSET WITH ADJUSTABLE MICROPHONE SUPPORT AND METHOD FOR ADJUSTING MICROPHONE

(71) Applicant: Shure Acquisition Holdings, Inc., Niles, IL (US)

(72) Inventors: Michael Alwicker, Chicago, IL (US); Daniel Pratt, Niles, IL (US); Charles Wiseman, Chicago, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 15/870,089

(22) Filed: Jan. 12, 2018

(65) Prior Publication Data

US 2019/0222911 A1 Jul. 18, 2019

(51) Int. Cl.
*H04R 25/00* (2006.01)
*H04R 1/08* (2006.01)

(52) U.S. Cl.
CPC ..... *H04R 1/08* (2013.01)

(58) Field of Classification Search
CPC ..... H04R 1/08
USPC ..... 381/362
See application file for complete search history.

(56) References Cited

U.S. PATENT DOCUMENTS 4,039,765 A * 8/1977 Tichy ..... H04M 1/05 379/430
4,420,657 A * 12/1983 Larkin ..... H04M 1/05 181/129
4,875,233 A * 10/1989 Derhaag ..... H04M 1/05 379/430
D309,305 S * 7/1990 von Hall ..... D14/225
4,987,592 A * 1/1991 Flagg ..... H04M 1/05 379/430
D348,067 S 6/1994 Lucey et al.
5,369,857 A * 12/1994 Sacherman ..... H04R 5/0335 29/594
5,446,788 A 8/1995 Lucey et al.
5,450,496 A 9/1995 Bunis et al.
5,708,724 A 1/1998 Burris et al.
D404,734 S 1/1999 Andrea
(Continued)

FOREIGN PATENT DOCUMENTS

WO 9917586 A1 4/1999

OTHER PUBLICATIONS

Sennheiser 500692 HSP 2-ew-3-M Microphone Headset—Sep. 27, 2017.

(Continued)

*Primary Examiner* — Phylesha Dabney
(74) *Attorney, Agent, or Firm* — Banner & Witcoff, Ltd.

(57) ABSTRACT

A communications headset in which a microphone at the end of a support boom can be adjustably secured in a position selected by the wearer and can accommodate a variety of wearers. The headset may include a boom arm clip configured to receive a boom arm retaining a microphone. The boom arm clip can include an opening, and the opening may include a pair of grooves, the pair of grooves together can define a channel sized to fit and retain the boom arm therein. The headset may also include an adjusting knob, which can secure the boom arm clip in order to adjustably fix the boom arm in a number of positions on the headset to accommodate for different sized users.

20 Claims, 11 Drawing Sheets

(56) References Cited

U.S. PATENT DOCUMENTS

| | | | | |
|---|---|---|---|---|
| 5,960,094 | A * | 9/1999 | Jensen | H04M 1/05 381/374 |
| 6,097,809 | A | 8/2000 | Lucey et al. | |
| D443,870 | S | 6/2001 | Carpenter et al. | |
| 6,252,970 | B1 | 6/2001 | Poon et al. | |
| D451,902 | S | 12/2001 | Gustafson | |
| 6,377,684 | B1 | 4/2002 | Lucey et al. | |
| 6,411,709 | B1 | 6/2002 | Lucey | |
| 6,490,362 | B1 * | 12/2002 | Clegg | H04R 1/083 379/430 |
| 6,728,388 | B1 * | 4/2004 | Nageno | H04R 1/105 381/330 |
| 6,920,228 | B2 | 7/2005 | Redmer et al. | |
| 7,099,464 | B2 | 8/2006 | Lucey et al. | |
| 7,391,863 | B2 * | 6/2008 | Viduya | H04M 1/05 379/430 |
| 8,170,231 | B2 | 5/2012 | Garra et al. | |
| D667,815 | S | 9/2012 | Chiu et al. | |
| 8,611,579 | B2 * | 12/2013 | Console | H04R 1/08 381/355 |
| D776,637 | S * | 1/2017 | Chen | D14/206 |
| 2003/0002706 | A1 * | 1/2003 | Keliiliki | H04R 1/1066 381/381 |
| 2009/0274331 | A1 * | 11/2009 | Weng | H04R 1/105 381/364 |
| 2010/0014699 | A1 | 1/2010 | Anderson et al. | |
| 2011/0228925 | A1 * | 9/2011 | Birch | H04M 1/05 379/428.02 |
| 2017/0295419 | A1 * | 10/2017 | Poulsen | H04R 5/04 |

OTHER PUBLICATIONS

Rode HS1B Headset Mic Dubai—Sep. 27, 2017.

Arama Headset with Noise Canceling Boom Mic and Adjustable Fit Headband for iPhone Samsung Blackberry LG Huawei HTC ZTE Mobile Phone and Smartphones with 3.5mm Jack (A200MP).

Line 6 HS70—Headset Mic, Tan Demo.

Apr. 10, 2019—(PCT)—ISR and Written Opinion—App PCT/US2019/013062.

* cited by examiner

HEADSET WITH ADJUSTABLE MICROPHONE SUPPORT AND METHOD FOR ADJUSTING MICROPHONE

RELATED APPLICATIONS

This Application relates to U.S. application Ser. No. 15/235,382 filed on Aug. 12, 2016, which is fully incorporated herein by reference.

FIELD

The present disclosure relates generally to a microphone-supporting headset of the type used in connection with communications, recording and broadcasting systems.

BACKGROUND

Headsets permit the use of a microphone and/or earphones while allowing the user freedom of his or her hands while speaking. In many situations, use of a hands free communication device may be desired for various multitasking purposes. Headsets can require adjustments by the user at each use or when switching from one user to the next.

SUMMARY

This Summary provides an introduction to some general concepts relating to this disclosure in a simplified form that are further described below in the Detailed Description. This Summary is not intended to identify key features or essential features of the invention.

Aspects of the disclosure pertain to a headset having an adjustable boom arm for accommodating a variety of wearers. The headset may also include a boom arm clip configured to receive a boom arm retaining a microphone. The boom arm clip can include an opening, and the opening may include a pair of grooves, the pair of grooves together can define a channel sized to fit and retain the boom arm therein. The headset may also include an adjusting knob, which is configured to secure the boom arm clip in place on the headset in order to adjustably fix the boom arm in a number of positions on the headset to accommodate for different sized users and/or to optimize the performance of the microphone.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "frontside," "backside," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

Figure 1:
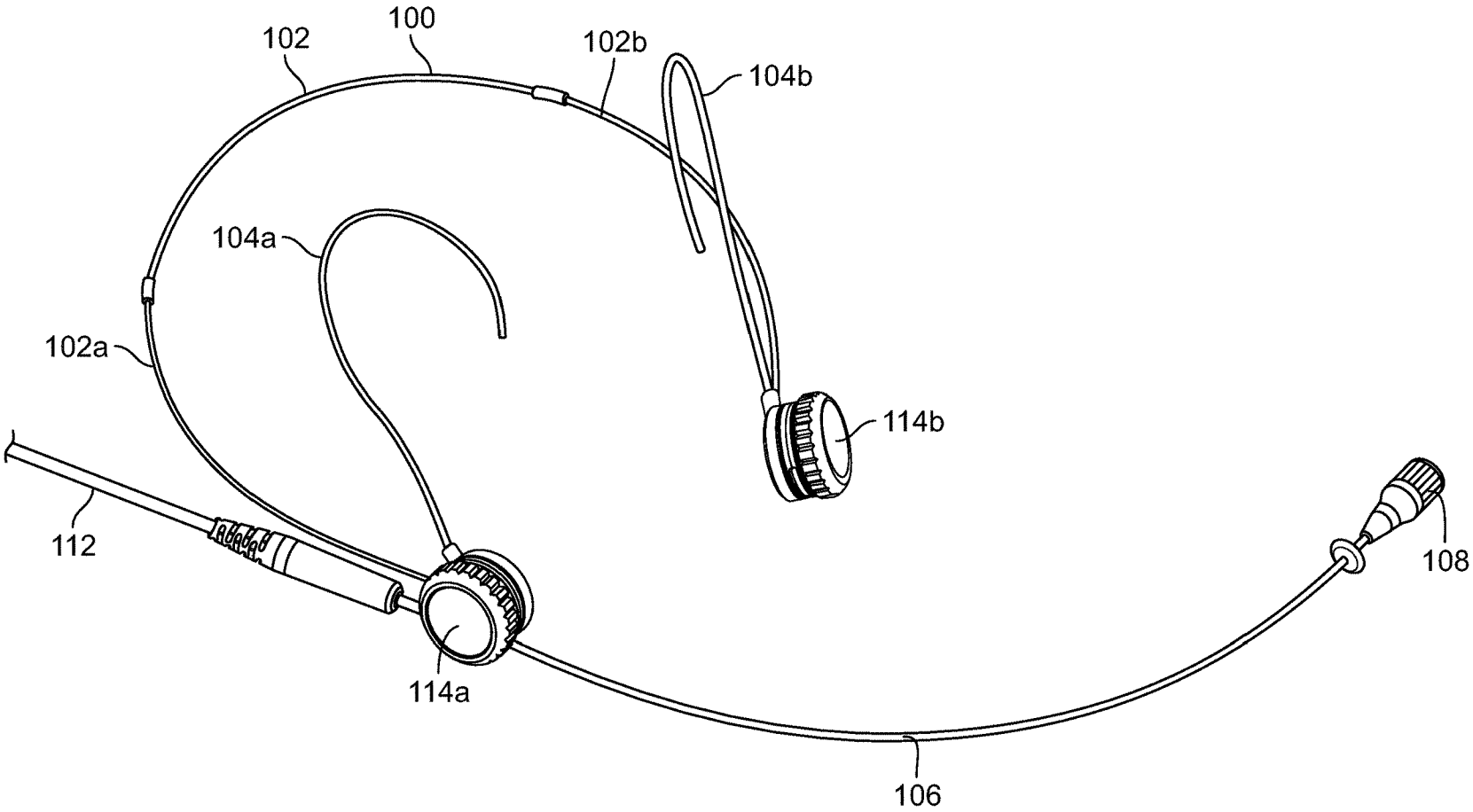
FIG. 1 shows a perspective view of an example headset.
Figure 2:
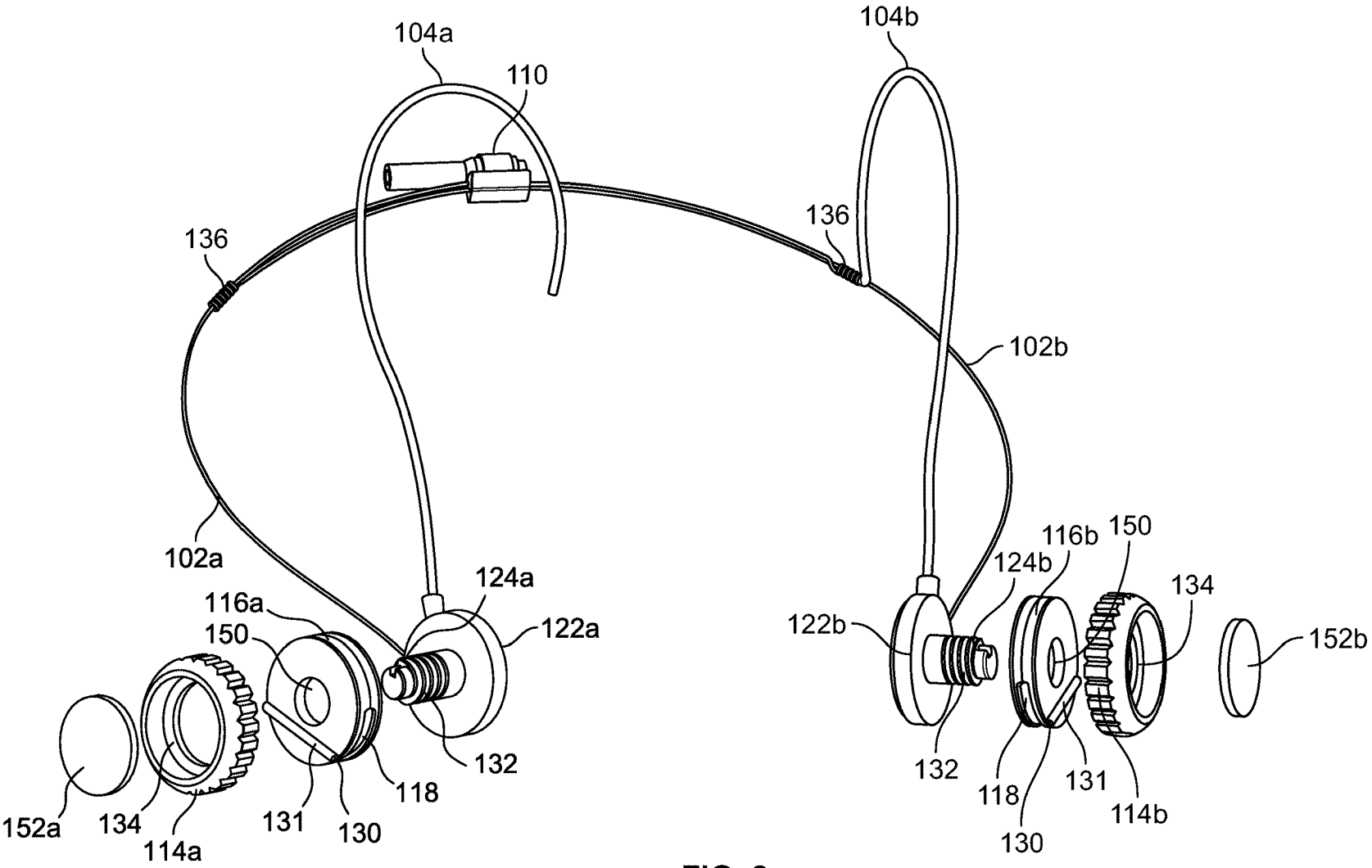
FIG. 2 shows an exploded view of the example headset of FIG. 1 without the boom arm and microphone.
Figure 2A:
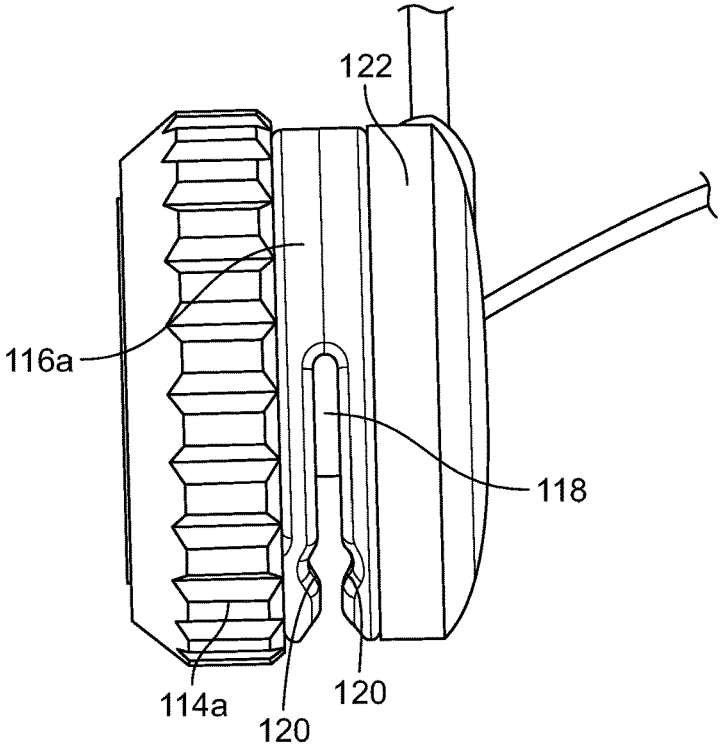
FIG. 2A shows an enlarged perspective view of a portion of the example headset of FIG. 1.

FIG. 1 shows a perspective view of an example headset 100, and FIG. 2 shows an exploded view of the example headset without the boom arm 106. The headset 100 can include an adjustable neckband 102, a pair of ear hooks or ear hangers 104*a*, 104*b*, a boom arm 106 for receiving a microphone 108, a cable clamp 110 for receiving the microphone cable 112, which can extend behind the user, and a pair of adjustment knobs 114*a*, 114*b* for adjusting the position of the boom arm 106.

As shown in FIG. 2, the headset 100 can include a pair of circular bases or flanges 122*a*, 122*b* and posts 124*a*, 124*b*, as will be discussed in more detail below. The circular bases 122*a*, 122*b* can in one example be integrally formed with the posts 124*a*, 124*b*. The circular bases 122*a*, 122*b* and posts 124*a*, 124*b* form the main connections between the elements of the headset 100. Each of the circular bases 122*a*, 122*b* and posts 124*a*, 124*b* are configured for receiving ear hooks 104*a*, 104*b* and flexible members 102*a*, 102*b* that together form the neckband 102. Posts 124*a*, 124*b* can extend from the circular bases 122*a*, 122*b*, and can include threads 132 for receiving the adjustment knobs.

Figure 3:
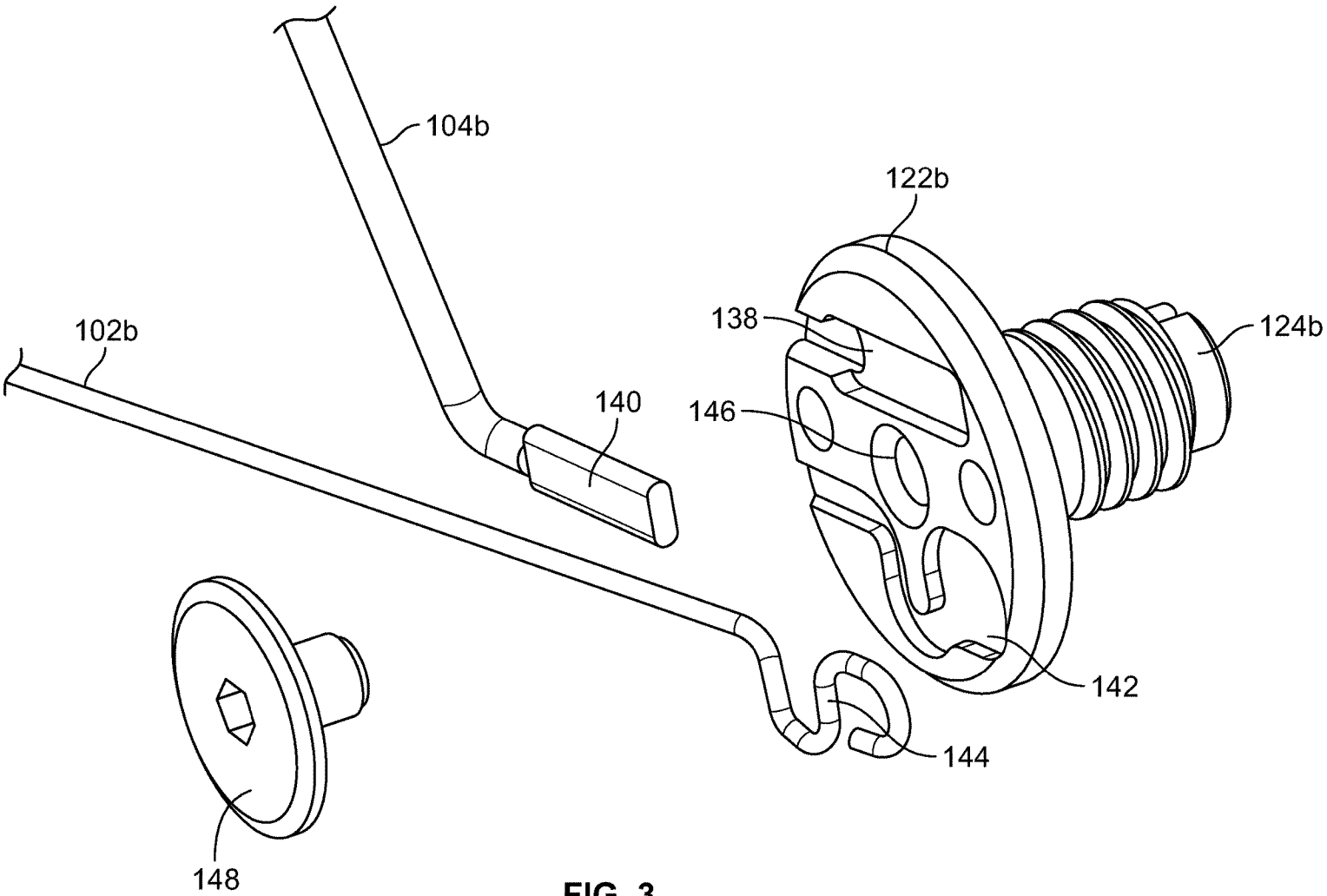
FIG. 3 shows a partial exploded view of a portion of the example headset of FIG. 1.
Figure 4:
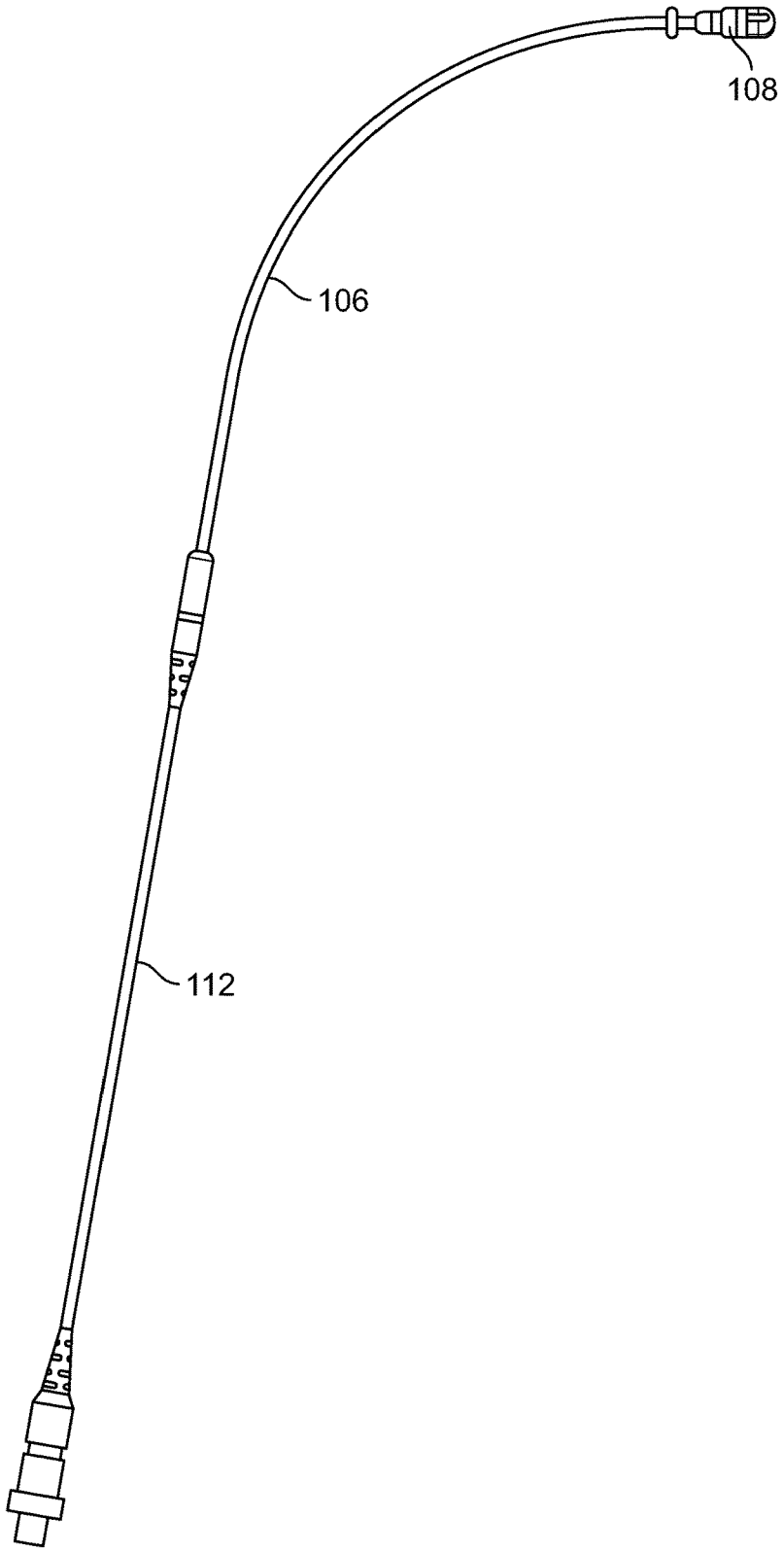
FIG. 4 shows a top view of the example boom arm and microphone of FIG. 1
Figure 5A:
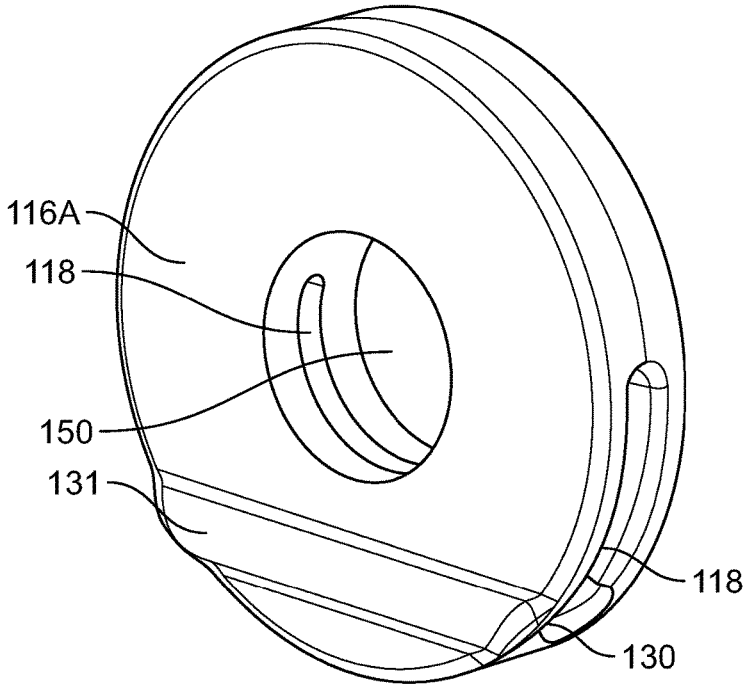
FIG. 5A shows a perspective view of an example boom arm clip.
Figure 5B:
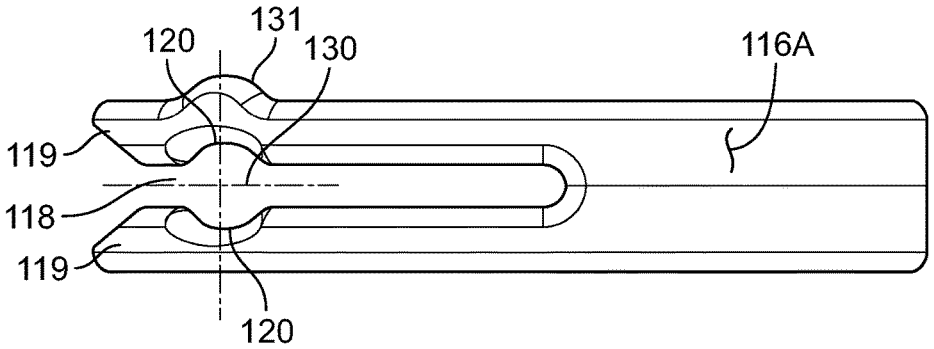
FIG. 5B shows a front view of the example boom arm clip of FIG. 5A.
Figure 5C:
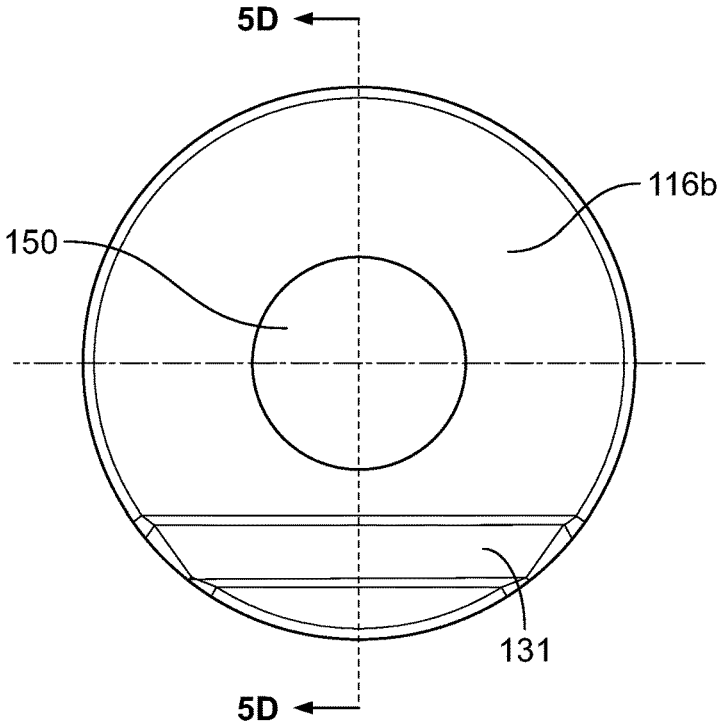
FIG. 5C shows a side view of the example boom arm clip of FIG. 5A.
Figure 5D:
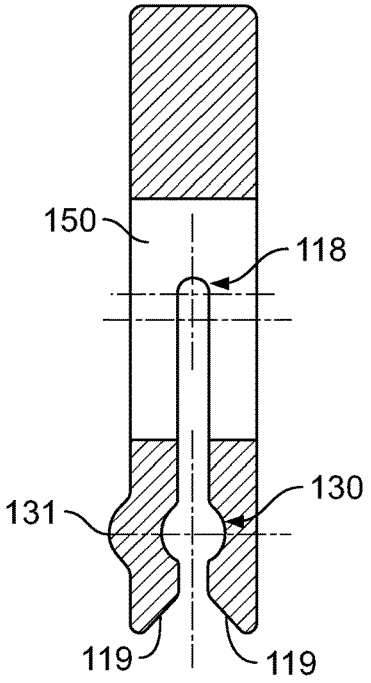
FIG. 5D shows a cross-sectional view of the boom arm clip of FIG. 5A along line 5D in FIG. 5C.

Also as shown in FIG. 3, the circular bases 122*a*, 122*b* can include mounting features for the ear hooks 104*a*, 104*b* and the neckband 102. Although only circular base 122*b* is depicted in FIG. 3, it is understood that circular base 122*a* can include the same features and functionality as circular base 122*b*. The circular base 122*b* can include a first groove or first impression 138 corresponding to an ear hook mount 140 connected to the ear hook 104*b* and a second groove or second impression 142 corresponding to a neckband mount 144 and an opening 146 for receiving a screw 148. The screw 148 may be configured to secure the ear hook 104*b* into the first groove 138 and to secure the flexible member 102*b* of the neckband 102 into the second groove. Additionally, the ear hook 104*b*, the flexible member 102*b* of the neckband 102, and the screw 148 can all be over molded onto the circular base 122*b* in a suitable injection molding operation, such that a permanent connection is formed between each of the elements and to give the headset a better look and softer feel to prevent the headset 100 from scratching the user or getting caught in the user's hair.

Figure 2B:
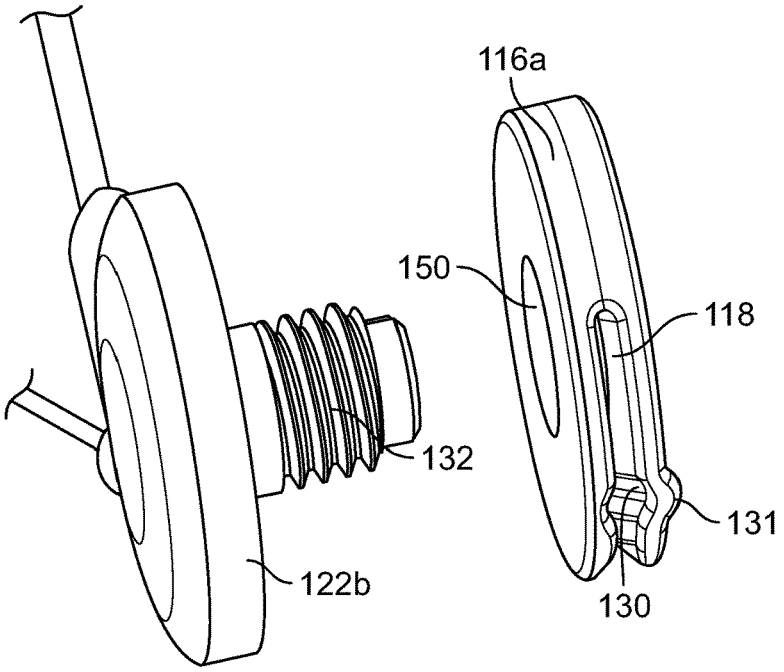
FIG. 2B shows an enlarged, exploded, perspective view of a portion of the example headset of FIG. 1.

The headset 100 may also include boom arm clips 116*a*, 116*b* configured to receive the boom arm 106 retaining the microphone 108. The boom arm clips 116*a*, 116*b* are shown in conjunction with the headset 100 in FIGS. 1-2B and separately in FIGS. 5A-5D. The headset 100 can include a pair of boom arm clips 116*a*, 116*b* for receiving the boom arm 106 on either side of the headset, and each boom arm clip 116*a*, 116*b* can be formed identically and can have identical functionality. In this way, the user can loosen the adjustment knobs 114*a*, 114*b* to move the boom arm 106 in the desired position on the headset 100 or to remove the boom arm from one of the boom arm clips and place the boom arm 106 onto the other side of the headset 100. Yet, in other examples, the adjusting knobs 114*a*, 114*b* can be configured to be removable if desired for repair or replacement of components of the headset 100.

Figure 2C:
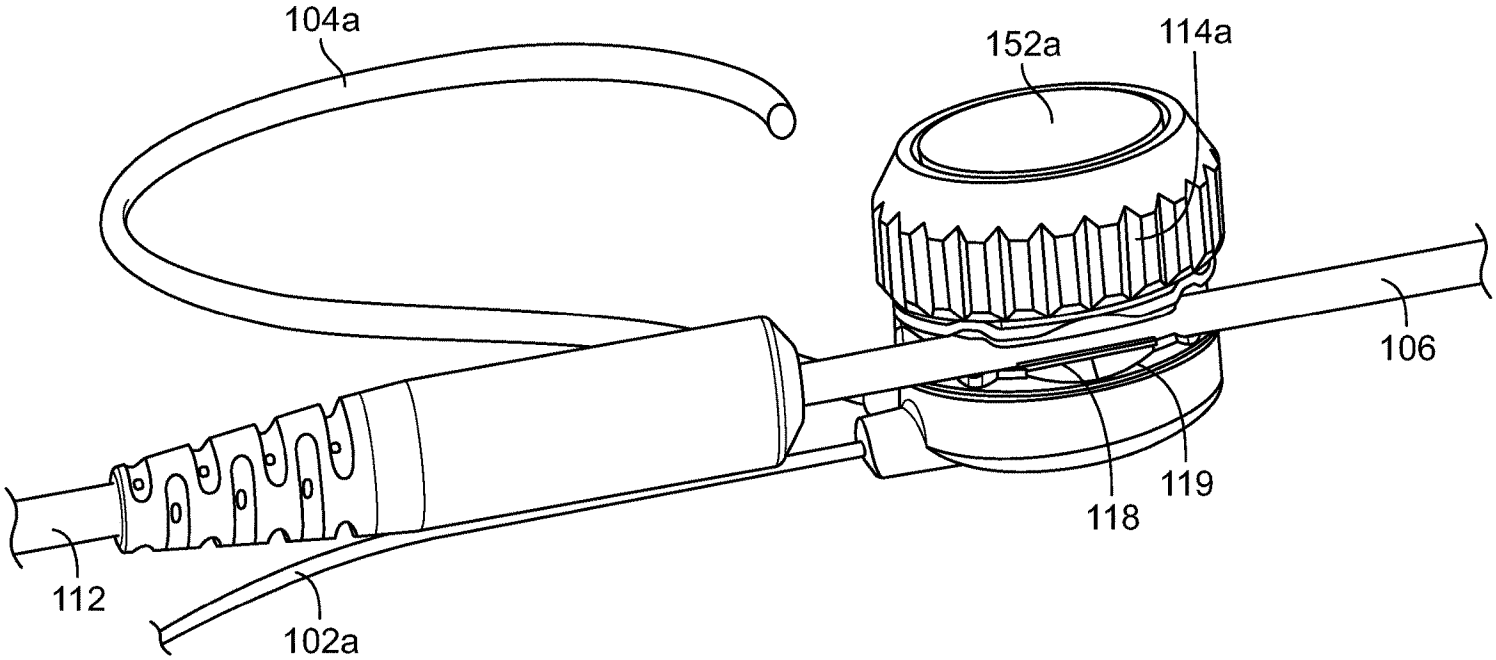
FIG. 2C shows another enlarged perspective of a portion of the example headset of FIG. 1.

The boom arm clips 116*a*, 116*b* can include an slot opening 118, and the slot opening 118 may include a pair of grooves 120, the pair of grooves 120 together can define a channel 130 sized to fit and retain the boom arm 106 therein. Additionally, the slot opening can be provided with tapered walls 119, which can help to ease the placement of the boom arm 106 into the channel 130 by allowing the boom arm 106 to slide up the tapered walls 119 and into the channel 130. Also as shown in FIG. 2C, only certain sections of the channel 130 can be formed with tapered walls 119 to provide a curved profile when viewed from the bottom. This may help to both provide an adequate force for the boom arm clip to maintain the boom arm 106 therein and to allow for it to also be placed therein during assembly or when moving the boom arm 106 from one side of the headset 100 to the other.

Figure 7A:
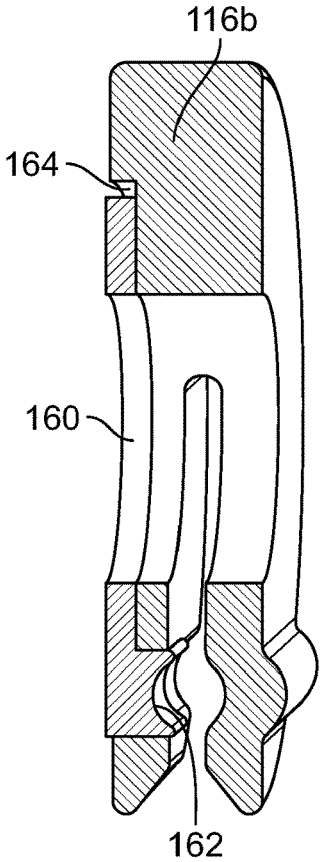
FIGS. 7A-7C show an alternative boom arm clip example.
Figure 7B:
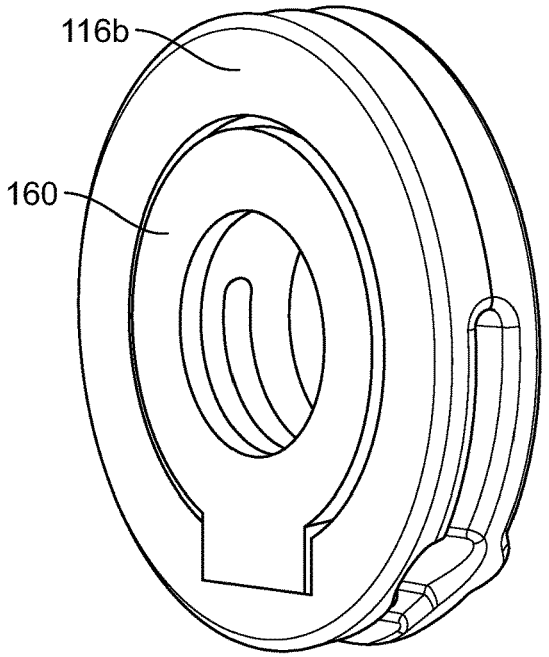
Figure 7C:
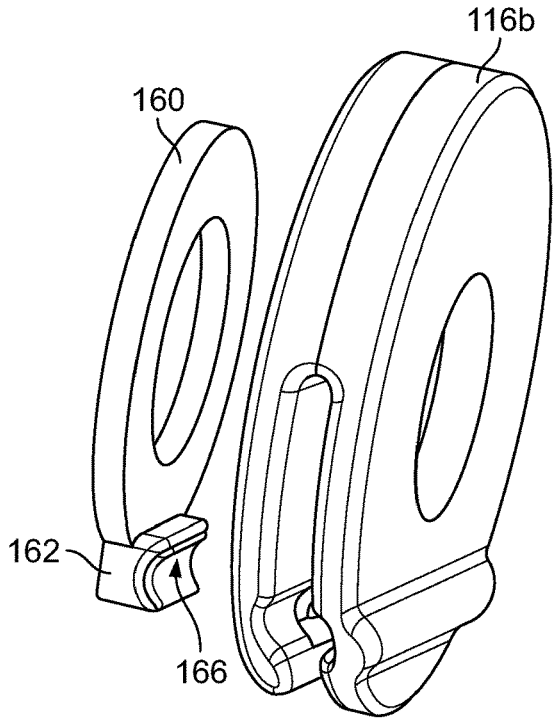

In another example, as shown in FIGS. 7A-7C, an additional washer 160 with a curved portion 162 can be added to the boom arm clips 116*a*, 116*b* to help with increasing the grip force between the boom arm clips 116*a*, 116*b* and the boom arm 106. The boom arm clips 116*a*, 116*b* can be formed with a cutout portion 164 for receiving the washer 160 and curved portion 162. The curved portion 162 can include a surface 166, which can include a rough texture or a knurl to increase the grip force of the channel 130 when in contact with the boom arm 106. In another example, a metal insert can be added to the washer 160 to help with grip at the interface. The metal insert can be formed of brass, steel, or stainless steel in certain examples. But, other suitable materials are also contemplated.

Additionally, the channel 130 itself can be formed with a textured surface, or can be molded with a coating in the form of a spray, such as Pasti Dip to prevent the rotation of the boom arm 106 in the channel 130. Also a paint finish could be applied to the channel 130 containing particles such as sand to provide further anti-rotational holding power by providing an anti-slip grit paint texture against movement of the boom arm 106. Also or alternatively, a soft plastic or rubber material to create additional friction to hold the boom arm 106 in place.

Figure 6:
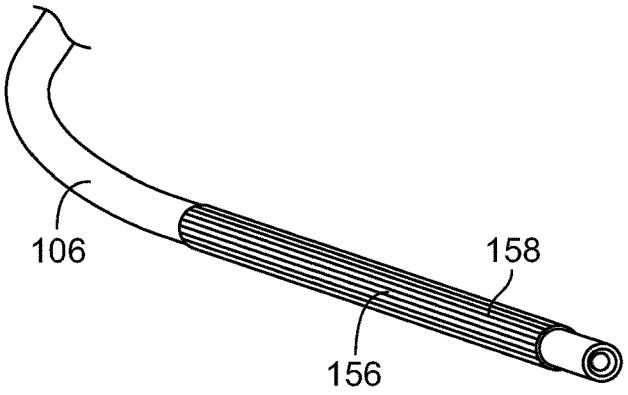
FIG. 6 shows a perspective view of an alternative boom arm example.

Yet in conjunction or in the alternative, the channel 130 and the boom arm 106 can also be provided with one or more mating features for securing the boom arm in place, as shown in FIG. 6. As shown in FIG. 6, the boom arm 106 can be provided with a detented sleeve piece 156, which has a series of detents or ribs 158, and the boom arm clips 116*a*, 116*b* in the channel 130 can be provided with a corresponding set of detents or notches for receiving the detented sleeve piece 156 of the boom arm 106. In addition or alternatively, the channel 130 and the boom arm 106 can be provided with an octagon, hexagon, or like profile such that the corresponding sides of the channel 130 and the boom arm 106 hold the boom arm 106 in place on the headset 100 by preventing rotation of the boom arm 106.

Likewise, the boom arm 106 can be formed with a textured surface, or can be molded with a coating in the form of a spray, which in one example can be Plasti Dip to prevent rotation within the channel 130. Also a paint finish could be applied to the boom arm 106 containing particles such as sand to provide further anti-rotational holding power by providing an anti-slip grit paint texture against the channel 130. And or alternatively, a soft plastic or rubber material could be added to the boom arm 106 to create additional friction to maintain the boom arm 106 in place in the channel 130. Additionally or alternatively, the boom arm 106 can be provided with a flat surface and the channel 130 can be provided with a corresponding flat surface to engage the corresponding flat surface of the channel 130. The flat surface can be formed on the boom arm 106 by separate welding of a plate or the boom arm 106 can be molded or formed with a flat surface. This helps to prevent rotation of the boom arm 106 on the headset 100. In certain examples, the boom arm 106 can be formed of stainless steel, titanium or alloys thereof, or suitable plastics. Yet, shape memory alloys or shape memory plastics may also be used to form the boom arm 106.

Figure 8:
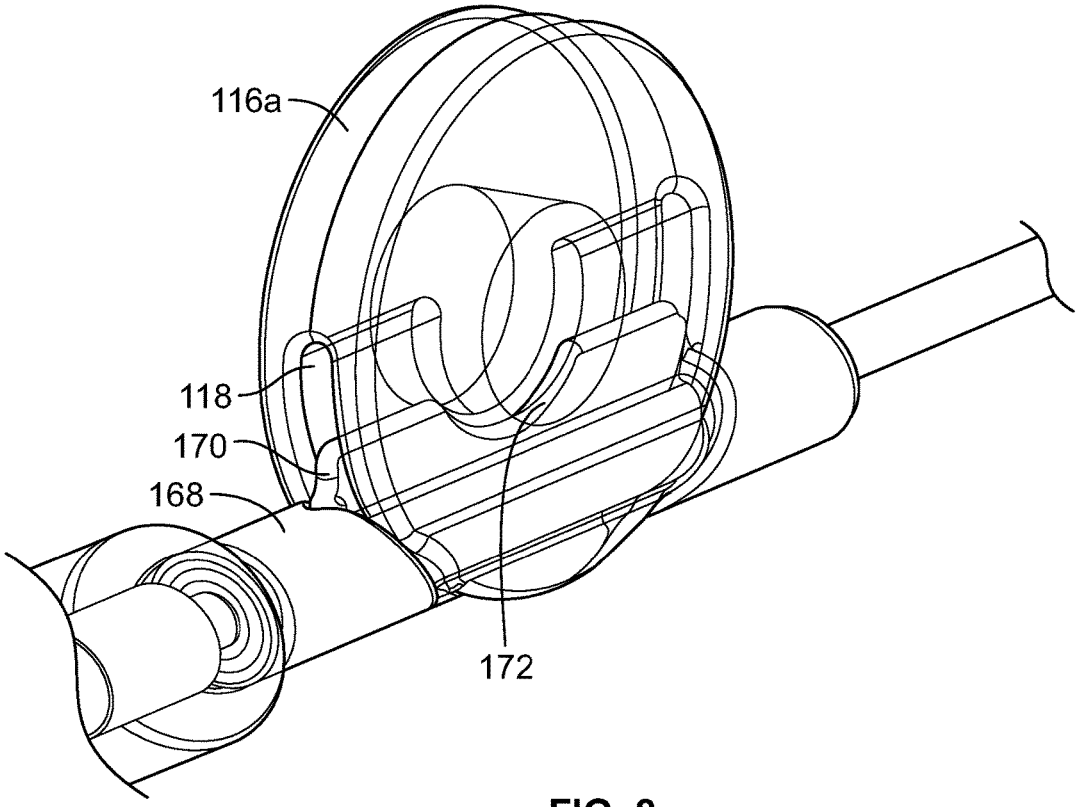
FIG. 8 shows a perspective view of an another alternative example.

In yet another example, as shown in FIG. 8, the boom arm 106 can be provided with an alternative sleeve piece 168, which includes a fin 170. The fin 170 can be configured to extend radially from the sleeve piece 168. And, the fin 170 can be configured to engage and key into the boom arm clips 116*a*, 116*b* in the channel 130. The fin 170 may also include a curved notch 172 for accommodating posts 124*a*, 124*b*. The sleeve piece 168, in certain examples, can be molded over the boom arm 106. And, in certain examples can be formed of silicone polymer or a silicon-based material. This, like in the above examples, helps to prevent rotation of the boom arm 106 on the headset 100, thus, completely removing the rotational degree of freedom. It is also contemplated that the sleeve piece 168 can be provided with multiple fins at various radial locations and various orientations along the sleeve piece, which may be parallel or not parallel with the axis of the sleeve piece 168.

Also an elongated curved ridge or projection 131 can be formed on one surface of the boom arm clips 116*a*, 116*b*. When assembled, the adjusting knobs 114*a*, 114*b* can press against the elongated curved ridge 131 to force the channel 130 in place around the boom arm 106, thereby holding it into place onto the headset 100. As discussed in more detail below, the boom arm clips 116*a*, 116*b* can be formed of a resilient material, and also, the opening 118 provides a degree of flexibility on the boom arm clips 116*a*, 116*b*, such that the channel 130 can be biased against the boom arm 106 to retain the boom arm 106 in place on the headset 100, and, in one example, the opening 118 can extend to the through 150 hole of the boom arm clips 116*a*, 116*b*. Each boom arm clip 116*a*, 116*b* can be formed of one integral component.

However, it is also contemplated that the boom arm clips can be formed of two separate washers or washer-like elements to provide the opening 118 and channel 130 for the boom arm 106.

Additionally, the boom arm clips 116*a*, 116*b* can be formed circular and may each include a through-hole 150 for receiving their respective posts 124*a*, 124*b*. The through holes 150 may define axes, which coincide with the axes of the posts 124*a*, 124*b*. The boom arm clips can rotate 360 degrees about the center axes. This allows the user flexibility to position the boom arm 106 as they please in a large arc about the center axes. The boom arm clips 116*a*, 116*b* can be positioned on their posts 124*a*, 124*b*, such that each post extends through each axis of the boom arm clips 116*a*, 116*b*. The channel 130 may extend perpendicular to the axis, such that when mounted the boom arm 106 is also perpendicular to the axis of the post at least at the location where the boom arm 106 extends through the boom arm clips 116*a*, 116*b*. The boom arm clip slots 118 can extend approximately 180 degrees on the boom arm clips 116*a*, 116*b*. This may help to provide a degree of flexibility of securing the boom arm 106 therein such that when the adjusting knobs 114*a*, 114*b* are tightened against the curved ridge 131 of the boom arm clips 116*a*, 116*b*, the boom arm clips 116*a*, 116*b* grip the boom arm 106 therein.

The headset 100 may also include a pair of adjusting knobs 114*a*, 114*b*. The adjusting knobs 114*a*, 114*b* can include threads 134, which are configured to threadingly secure to the posts 124*a*, 124*b* by way of corresponding mating with the threads 132 on the posts 124*a*, 124*b*. The adjusting knobs 114*a*, 114*b* can be tightened or loosened on the posts 124*a*, 124*b* such that the user can adjust the boom arm 106 by way of the boom arm clips 116*a*, 116*b* in a number of positions on the headset 100 to accommodate for different sized users. The boom arm 106 can also be removed to move it from one side of the headset to the other side of the headset 100.

The boom arm clips 116*a*, 116*b* can be configured to secure onto the posts 124*a*, 124*b* in order to secure the boom arm 106 by way of interaction with the adjusting knobs 114*a*, 114*b*. In particular, the adjusting knobs 114*a*, 114*b* bias the boom arm clips 116*a*, 116*b* inward against the boom arm 106 by interacting with the curved ridge 131. The boom arm clips 116*a*, 116*b* can be formed of a flexible material and the channels 130 in the boom arm clips 116*a*, 116*b* can be narrowed as the adjusting knobs 114*a*, 114*b* are tightened. As the adjusting knobs are tightened against the circular bases 122*a*, 122*b*, the channels 130 are narrowed in order to grip and hold the boom arm 106 in place on the headset. Likewise, when the adjusting knobs 114*a*, 114*b* are loosened, the channel width increases slightly allowing the user to move the boom arm 106 perpendicular to the post 124*a*, 124*b* or the post axis. Also, the user can articulate the boom arm 106 about the post 124*a*, 124*b* or the post axis on the headset 100, since the boom arm clips 116*a*, 116*b* are allowed to rotate freely about the post axis when the adjusting knobs 114*a*, 114*b* are loosened. In this way, the boom arm 106 is adjustable to accommodate a variety of users.

The neckband 102 sits along the user's neck during use, and can be configured to extend from the first circular base 122*a* to the second circular base 122*b*. In one example, the neckband 102 can be arranged in a curved semi-eliptical or semi-circular shape. The neckband 102 can include a pair of flexible elements or members 102*a*, 102*b*, which can be a pair of curved and resilient wires and can have a high degree of shape memory for bending in multiple directions. The flexible elements 102*a*, 102*b* can be formed of a lightweight plastic, metal, or other suitable material with or without shape memory. Also the neckband 102 can be configured to be adjustable such that the neckband 102 can accommodate different sized users.

Specifically, as shown in FIG. 2, each flexible member 102*a*, 102*b* can include a coiled end 136, where each of the coiled ends 136 form an opening for receiving the other one of the pair of flexible elements. In this way each wire 102*a* and 102*b* can slide relative to one another to make the length of the neckband 102 either larger or smaller. As the user slides the flexible members 102*a*, 102*b* in the coiled ends 136, the neckband 102 can be made either larger or smaller to accommodate for different users. In other examples, each end of the pair of wires 102*a* and 102*b* may include a slot for receiving the other wire therein and a projection on each end for limiting the travel of the pair of wires 102*a*, 102*b*.

In one example, the ear hangers 104*a*, 104*b* can be rounded so as to extend over the user's ears. Each of the ear hangers 104*a*, 104*b* can be symmetrical. The ear hangers 104*a*, 104*b* can be formed of a flexible lightweight plastic, metal, or suitable wire-like material having a higher degree of shape memory for bending in multiple directions. In certain examples, the ear hangers 104*a*, 104*b* can be formed of a more comfortable material for the user's ears or may include a liner or cushion for interfacing with the user's ears to increase comfort. In certain examples, the liner or cushion could be formed of a softer plastic such as a rubber material or a foam or foam-like material.

In one example, although not shown it is also contemplated that the headset 100 can be outfitted with other types of hands-free communication devices either separately or in conjunction with a microphone. For example, an ear phone or other communication device can be included on the headset 100. It is also contemplated that the headset 100 could be formed with only one ear hook device. Moreover, the headset 100 could be formed such that the ear hooks 104*a*, 104*b* and the neckband 102 are formed adjustable relative to one another. For example, the neckband 102 could be configured to be rotatable relative to the ear hooks 104*a*, 104*b*. Also the ear hooks 104*a*, 104*b* may also be configured to be rotated inwardly and outwardly to accommodate for different users. The ability of the neckband 102 and the ear hooks 104*a*, 104*b* to rotate relative to each other and the ear hooks 104*a*, 104*b* to rotate inwardly and outwardly can provide for simpler storage of the headset 100. In other examples, the headset 100 could include an over-the-head band instead of a neckband.

A method of forming the headset is described below. In one example, the circular base and post can be formed together as a bolt or screw for both sets of circular bases 122*a*, 122*b* and posts 124*a*, 124*b*. The method can include forming the first impression 138 for receiving the ear hook 104*b* and the second impression 142 for receiving the flexible member 102*b* of the neckband 102 on the head of the bolt. The method may also include placing the ear hook 104*b* in the first impression 138 and placing the neckband 102 in the second impression 142 and securing a screw 148 into the head of the bolt to hold the ear hook 104*b* and the flexible member 102*b* of the neckband 102 onto the bolt by way of injection molding. This overmold helps to cover over the structural attachment with a softer covering, which helps to prevent the user from being scraped or having their hair caught in the mechanical/screw attachment. However, other possibilities for securing the neckband 102 and the ear hook 104*b* onto the bolt may include welding, brazing, adhesives, such as epoxy, or mechanical crimping.

The method may also include molding the ear hook 104*b* and the flexible member 102*b* of the neckband 102 onto the bolt. The boom arm clip 116*b* can be formed with an opening 118 having a pair of grooves 120 to define a channel 130 or the boom arm clip can be formed of separate washer elements each having a reduced width portion and a groove corresponding in shape to the boom arm 106. The method can also include placing the boom arm clip 116*b* onto the shank of the bolt and then placing the boom arm 106 into the channel 130. The boom arm clip 116*b* can be positioned on the bolt such that the bolt extends through the axis of the boom arm clip 116*b*, and the channel 130 of the boom arm clip 116*b* extends perpendicular to the axis.

The method can also include providing an adjusting knob 114*b* to secure to the shank and to secure the boom arm clip onto the bolt in order to secure the boom arm in place on the headset. The caps 152*a*, 152*b* can then be added to the assembly by adhering the caps 152*a*, 152*b* to the posts 124*a*, 124*b*. Because the caps 152, 152*b* are secured to the posts 124*a*, 124*b*, the caps 152*a*, 152*b* act as stops for preventing the adjustment knobs 114*a*, 114*b* from coming off of the posts 124*a*, 124*b*. Yet, in the alternative, the caps 152*a* and 152*b* may be omitted or the caps 152*a*, 152*b* may be secured to the adjusting knobs 114*a*, 114*b* by way of friction fit or adhesives if it is desired to have the adjustment knobs 114*a*, 114*b* be removable from the posts 124*a*, 124*b*.

In one example, a headset for a microphone can include a circular base for receiving an ear hook and a neckband. A post can extend from the circular base. The headset may also include a boom arm clip configured to receive a boom arm retaining a microphone. The boom arm clip can include an opening, and the opening may include a pair of grooves, the pair of grooves together can define a channel sized to fit and retain the boom arm therein. The headset may also include an adjusting knob, which is configured to secure to the post. The adjusting knob can be configured to secure the boom arm clip onto the post in order to secure the boom arm in a number of positions on the headset to accommodate for different sized users. The headset can further include a second circular base for receiving a second ear hook, the neckband, and a second boom arm clip. The second boom arm clip is configured to receive the boom arm such that the boom arm can be placed on either side of the headset. The neckband extends from the first circular base to the second circular base, and the neckband is configured to be adjustable such that the neckband can accommodate different sized users. The neckband can include a pair of flexible elements, each flexible member having a coiled end, each of the coiled ends forming an opening for receiving the other one of the pair of flexible elements. The post and the adjusting knob can have mating threads, and the boom arm clip may include a projection. The adjusting knob may be configured to push against the projection to bias the boom arm clip around the boom arm.

The circular base can further include a first groove corresponding to the ear hook and a second groove corresponding to the neckband and an opening for receiving a screw. The screw may be configured to secure the ear hook into the first groove and to secure the neckband into the second groove. The ear hook, the neckband, and screw can be over molded onto the circular base. The boom arm clip can be circular and can define an axis. The boom arm clip can be positioned on the post such that the post extends through the axis of the boom arm clip. The channel can extend perpendicular to the axis. The boom arm clip slot can extend approximately 180 degrees on the boom arm clip.

In another example, a headset for a microphone can include a first circular base having a first ear hook, a first post receiving a first boom arm clip, and a first adjusting knob, a second circular base having a second ear hook, a second post receiving a second boom arm clip, and a second adjusting knob. The headset may also include a neckband extending between the first circular base and the second circular base. Both the first boom arm clip and the second boom arm clip can be configured to receive a boom arm retaining a microphone and the first boom arm clip, and the second boom arm clip can both comprise an opening. The opening can include a pair of grooves, the pair of grooves together can define a channel sized to fit the boom arm therein. The first adjusting knob and the second adjusting knob can be configured to secure the boom arm in place on the headset in a number of positions to accommodate for different users. The neckband may also be configured to be adjustable such that the neckband can accommodate different sized users. The neckband may also include a pair of flexible members, and each flexible member may include a coiled end. Each of the coiled ends can form an opening for receiving the other one of the pair of flexible members. The first and second posts and the first and second adjusting knobs can include mating threads. The boom arm clip can be circular and can define an axis. The first boom arm clip and the second boom arm clip may also include projections. The first adjusting knob and the second adjusting knobs can be configured to respectively push against the projection of the first boom arm clip and the projection of the second boom arm clip to bias the first boom arm clip and the second boom arm clip around the boom arm.

The first and second boom arm clips can be positioned on the first and second posts such that the first and second posts extend through the axes of the first and second boom arm clips. The channels can extend perpendicular to the axes. The first and second boom arm clip slots can extend approximately 180 degrees around the boom arm clips.

In another example, a method for forming a headset may include providing a bolt having a head and a shank, forming a first impression for receiving an ear hook and a second impression for receiving a band in the head, placing an ear hook in the first impression and placing a band in the second impression and securing a screw into the head to hold the ear hook and the band onto the bolt, providing a boom arm clip on the shank to receive a boom arm retaining a microphone, forming the boom arm clip with an opening having a pair of grooves to define a channel, placing a boom arm in the channel, and providing an adjusting knob to secure to the shank and to secure the boom arm clip onto the bolt in order to secure the boom arm in place on the headset.

The method may also include molding the ear hook and the band to the bolt, positioning the boom arm clip on the bolt such that the bolt extends through the axis, and the channel extends perpendicular to the axis.

The present invention is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

What is claimed is:

1. A headset for a microphone comprising:

a first circular base for receiving an ear hook, a band, and a post extending from the first circular base;

a boom arm clip configured to receive a boom arm retaining a microphone, the boom arm clip comprising a slot, the slot comprising a pair of grooves, the pair of grooves together defining a channel sized to fit and retain the boom arm therein; and an adjusting knob configured to secure to the post and configured to secure the boom arm clip onto the post in order to secure the boom arm in a number of positions on the headset to accommodate for different sized users.

2. The headset of claim 1 further comprising a second circular base for receiving a second ear hook, the band, and a second boom arm clip and wherein the second boom arm clip is configured to receive the boom arm such that the boom arm can be placed on either side of the headset.

3. The headset of claim 2 wherein the band extends from the first circular base to the second circular base, and the band is configured to be adjustable such that the band can accommodate different sized users.

4. The headset of claim 3 wherein the band comprises a pair of flexible elements, each flexible element having a coiled end, each of the coiled ends forming an opening for receiving the other one of the pair of flexible elements.

5. The headset of claim 1 wherein the post and the adjusting knob have mating threads and the boom arm clip further comprises a projection and the adjusting knob is configured to push against the projection to bias the boom arm clip around the boom arm.

6. The headset of claim 1 wherein the circular base further comprises a first groove corresponding to the ear hook and a second groove corresponding to the band and an opening for receiving a screw and the screw configured to secure the ear hook into the first groove and to secure the band into the second groove.

7. The headset of claim 6 further comprising an over mold for permanently securing the ear hook, the band, and screw to the first circular base.

8. The headset of claim 1 wherein the boom arm clip is circular and defines an axis.

9. The headset of claim 8 wherein the boom arm clip is positioned on the post such that the post extends through the axis of the boom arm clip, and wherein the channel extends perpendicular to the axis.

10. The headset of claim 8 wherein the boom arm clip slot extends approximately 180 degrees on the boom arm clip.

11. A headset for a microphone comprising:

a first circular base having a first ear hook, a first post receiving a first boom arm clip, and a first adjusting knob;

a second circular base having a second ear hook, a second post receiving a second boom arm clip, and a second adjusting knob;

a band extending between the first circular base and the second circular base;

wherein both the first boom arm clip and the second boom arm clip are configured to receive a boom arm retaining a microphone and wherein the first boom arm clip and the second boom arm clip both comprise a slot, the slot comprising a pair of grooves, the pair of grooves together defining a channel sized to fit the boom arm therein; and wherein the first adjusting knob and the second adjusting knob are configured to secure the boom arm in place on the headset in a number of positions to accommodate for different users.

12. The headset of claim 11 wherein the band is configured to be adjustable such that the band can accommodate different sized users.

13. The headset of claim 12 wherein the band comprises a pair of wires, each wire having a coiled end, each of the coiled ends forming an opening for receiving the other one of the pair of wires.

14. The headset of claim 11 wherein the first boom arm clip and the second boom arm clip further comprise projections and the first adjusting knob and the second adjusting knobs are configured to respectively push against the projection of the first boom arm clip and the projection of the second boom arm clip to bias the first boom arm clip and the second boom arm clip around the boom arm.

15. The headset of claim 11 wherein the first and second boom arm clips are circular and each define an axis.

16. The headset of claim 15 wherein the first and second boom arm clips are positioned on the first and second posts such that the first and second posts extend through the axes of the first and second boom arm clips, and wherein the channels extend perpendicular to the axes.

17. The headset of claim 16 wherein the first and second boom arm clip slots extend approximately 180 degrees around the first and second boom arm clips.

18. A method for forming a headset comprising:

providing a bolt having a head and a shank;

forming a first impression for receiving an ear hook and a second impression for receiving a band in the head;

placing an ear hook in the first impression and placing a band in the second impression and securing a screw into the head to hold the ear hook and the band onto the bolt;

providing a boom arm clip on the shank to receive a boom arm retaining a microphone, forming the boom arm clip with an opening having a pair of grooves to define a channel, placing a boom arm in the channel; and providing an adjusting knob to secure to the shank and to secure the boom arm clip onto the bolt in order to secure the boom arm in place on the headset.

19. The method of claim 18 further comprising molding the ear hook and the band to the bolt.

20. The method of claim 18 further comprising positioning the boom arm clip on the bolt such that the bolt extends through an axis of the boom arm clip, and wherein the channel extends perpendicular to the axis.

* * * * *